United States Patent [19]

Salvati et al.

[11] 3,978,304

[45] Aug. 31, 1976

[54] ENCLOSED CIRCUIT INTERRUPTER INCLUDING EXTERNALLY OPERABLE HANDLE MECHANISM

[75] Inventors: John G. Salvati, Beaver Falls; Lawrence B. St. Clair, Beaver, both of Pa.

[73] Assignee: Westinghouse Electric Corporation, Pittsburgh, Pa.

[22] Filed: Dec. 10, 1974

[21] Appl. No.: 531,426

[52] U.S. Cl. ..... 200/331; 200/330; 200/50 A; 317/112; 74/520

[51] Int. Cl.[2] ..... H01H 9/02

[58] Field of Search ..... 317/112, 120; 200/153 V, 50 A, 330, 331, 332, 338; 74/110, 520, 544

[56] References Cited

UNITED STATES PATENTS

| | | | |
|---|---|---|---|
| 2,650,331 | 8/1953 | Clark | 200/50 A |
| 3,259,705 | 7/1966 | Freese | 200/50 A |
| 3,313,896 | 4/1967 | Gray | 200/50 A |
| 3,358,094 | 12/1967 | Metz | 200/50 A |

*Primary Examiner*—Gerald P. Tolin
*Attorney, Agent, or Firm*—R. E. Converse, Jr.

[57] ABSTRACT

A molded case circuit breaker enclosed in a metal cabinet with an openable cover. An operating mechanism has a mounting plate secured to the face of the circuit breaker and a sliding plate movably supported on rollers by the mounting plate at the side of the circuit breaker. A handle mechanism is secured to the sliding plate with a portion extending through an aperture in the cabinet cover. A gasket is disposed between the handle mechanism and the interior of the cabinet cover. The handle mechanism is spring-loaded against the gasket and interior of the cabinet cover to provide a dust-tight seal.

6 Claims, 7 Drawing Figures

ENCLOSED CIRCUIT INTERRUPTER INCLUDING EXTERNALLY OPERABLE HANDLE MECHANISM

BACKGROUND OF THE INVENTION

1. Field of the Invention

This invention relates in general to circuit interrupters and more particularly to enclosed circuit interrupters having an externally operable mechanism.

2. Description of the Prior Art

In industrial and commercial environments it is often desirable to provide a circuit breaker mounted in a metal cabinet or enclosure having an openable cover. Operation of the circuit breaker with the cover closed requires an external operating member mounted on or extending through to the outside of the housing. It is desirable to provide as a safety feature means to prevent opening of the cover when the circuit breaker is in an "ON" position. Various mechanisms providing this feature have been employed in the past, for instance those described in U.S. Pat. No. 3,259,705 issued to Gerald J. Freese and William W. Hamilton, Jr. and U.S. Pat. No. 3,358,094 issued to Robert P. Netz. Both of the above mentioned U.S. patents are assigned to the assignee of the present application. It is desirable to provide an improved control device comprising a circuit interrupter enclosed in a cabinet, a compact externally operable mechanism, and means to prevent opening of the enclosure cover when the circuit breaker is in the "ON" position.

SUMMARY OF THE INVENTION

In accordance with a preferred embodiment of the present invention there is provided an enclosure having an openable cover. A circuit interrupter is mounted within the enclosure and comprises an actuating lever movable to actuate the circuit interrupter to "ON" and "OFF" positions. An operating mechanism comprises a mounting plate affixed to the circuit interrupter, a sliding plate movably attached to the mounting plate at the side thereof and engaging the actuating lever, and a handle structure attached to the sliding plate. One portion of the handle structure extends through an aperture in the enclosure cover. Movement of the extending portion of the handle structure moves the sliding plate and the actuating lever to actuate the circuit interrupter to "ON" and "OFF" positions.

BRIEF DESCRIPTION OF THE DRAWINGS

The invention may be more readily understood by reference to the preferred embodiment of the invention shown in the accompanying drawings in which.

DESCRIPTION OF THE PREFERRED EMBODIMENT

Figure 1:
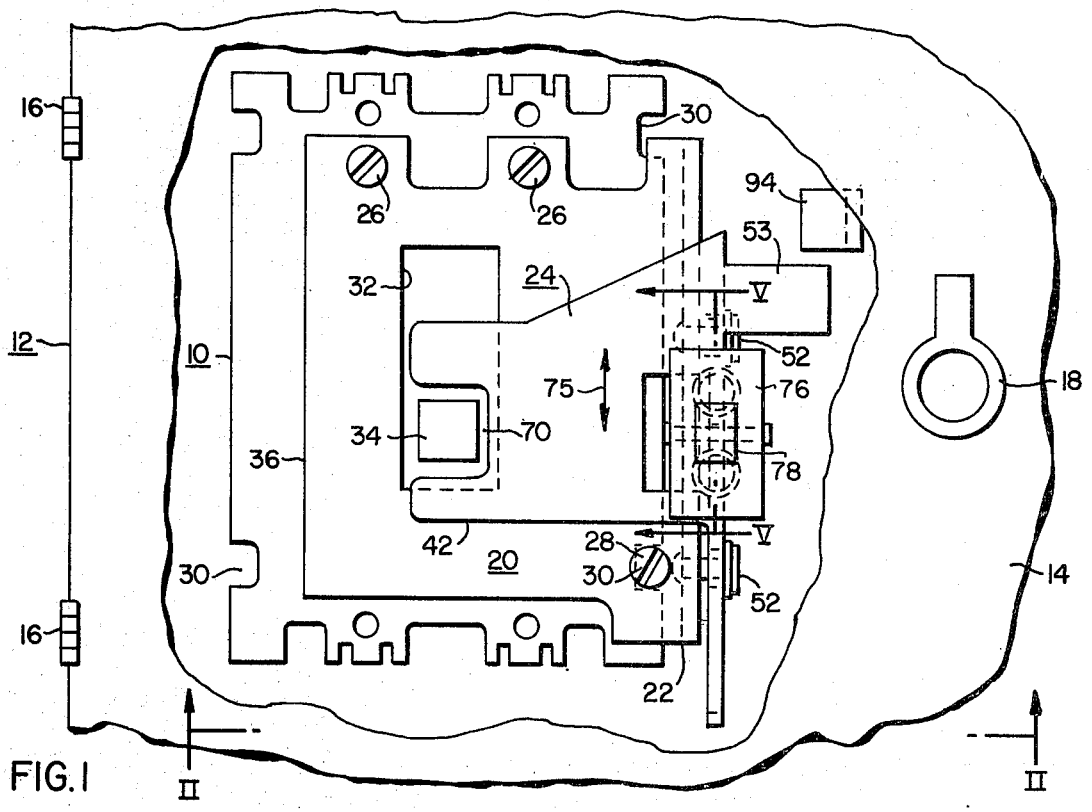
FIG. 1 is a front elevational view of a molded case circuit breaker and operating mechanism mounted in an enclosure, with the enclosure partly cut away.
Figure 2:
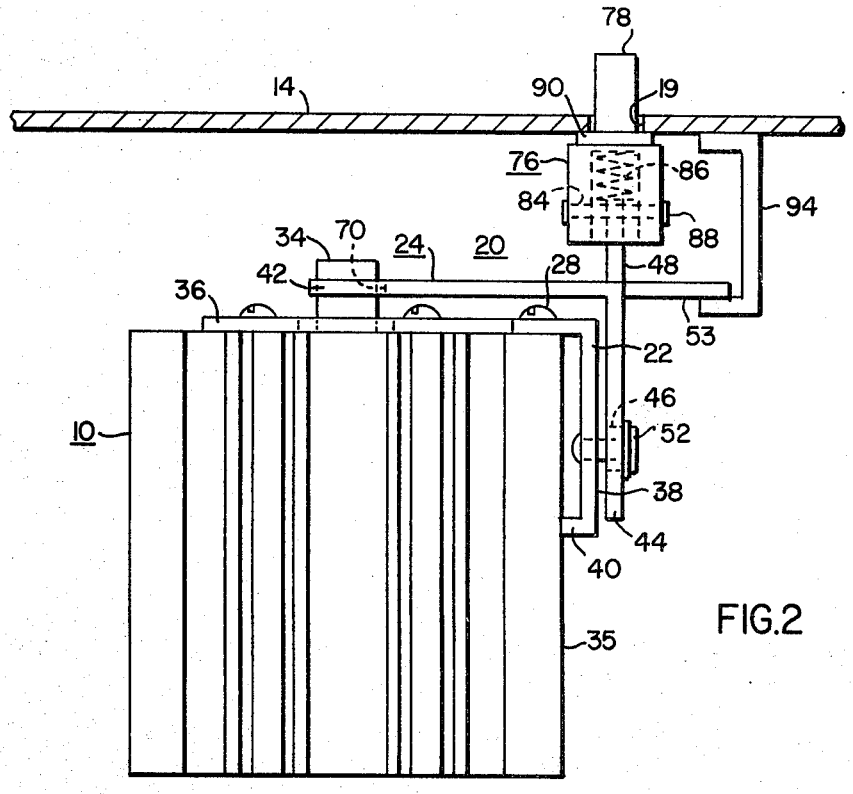
FIG. 2 is a sectional view of the circuit breaker, mechanism, an enclosure taken along the line II—II of FIG. 1.

Throughout the description like reference characters refer to like elements on all Figs. of the drawing. In FIG. 1 there is shown a molded case circuit breaker 10 mounted within a metal enclosure 12. An openable cover 14 is secured to the enclosure 12 by hinges 16 and includes a spring-loaded ring-shaped opening handle 18, and an aperture 19 (FIG. 2). The cover 14 is partially cut away in FIG. 1 to more clearly show an operating mechanism 20 comprising a mounting plate 22 and sliding plate 24.

Figure 4:
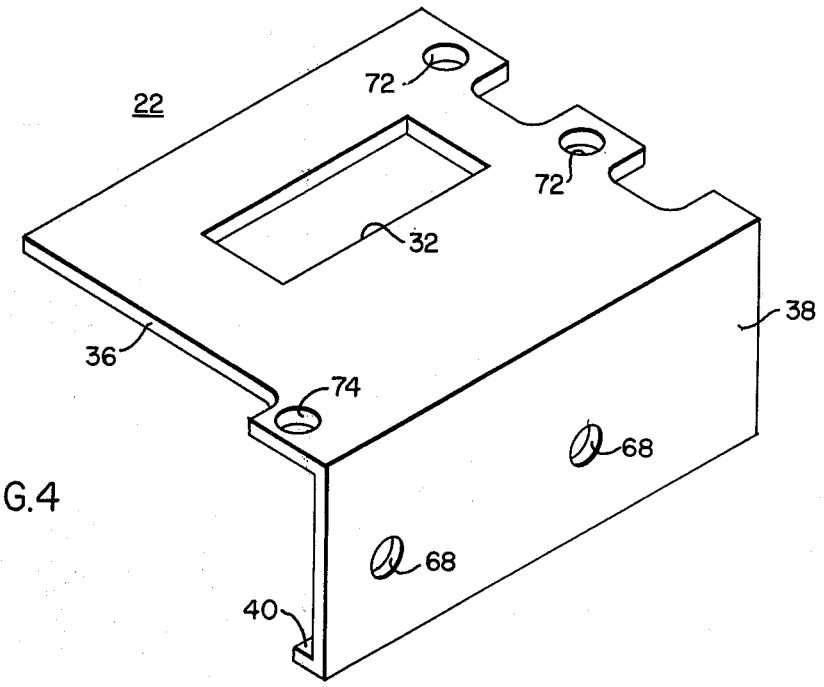
FIG. 4 is a perspective view of the mounting plate of the operating mechanism shown in FIGS. 1 and 2.

The mounting plate 22, shown more clearly in FIG. 4, includes a face member 36 parallel to the face of the circuit breaker 10 having a cut-out 32 through which extends the actuating lever 34 of the circuit breaker 10. A side member 38 extends perpendicular to the face member 36 and generally parallel to the side 35 of the circuit breaker 10. A lip 40 is formed at the edge of the side member 38 and abuts the side 35 of the circuit breaker 10 when mounted, thereby providing a stable mounting platform for the sliding plate 24. Two shoulder pin holes 68 are located in the side member 38.

Figure 3:
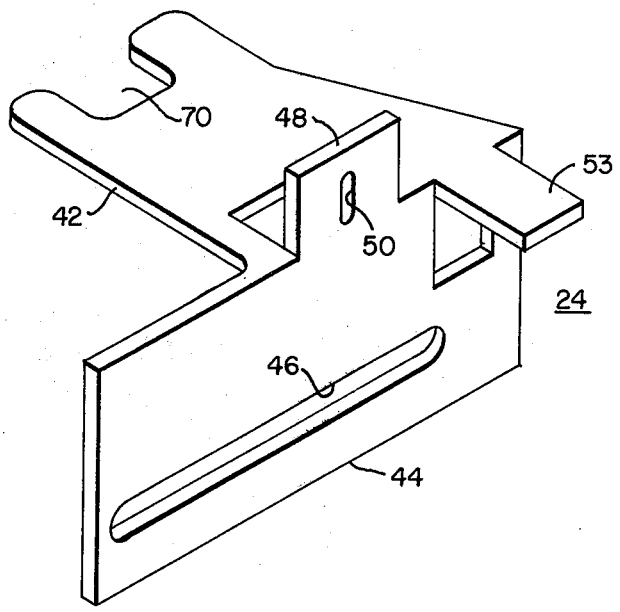
FIG. 3 is a perspective view of the sliding plate of the operating mechanism shown in FIGS. 1 and 2.

The sliding plate 24 shown in FIG. 3 includes a face member 42 and a side member 44 formed substantially perpendicular to the face member 42. A notch 70 is formed into the edge of the face member 42 to engage the actuating lever 34. The side member 44 includes a longitudinal slot 46 formed therethrough. A handle seating tab 48 extends vertically upward from the face member 42 in the same plane as the side member 44 and includes a vertical pin slot 50. Extending laterally from the side member 44 in the same plane as the face member 42 is an interlocking tab 53.

Figure 7:
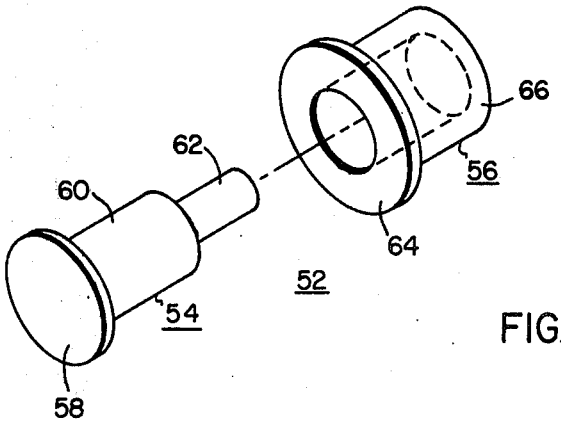
FIG. 7 is an exploded perspective view of one of the shoulder pins and rollers shown in FIG. 1.

FIG. 7 shows a roller bearing 52 consisting of a shoulder pin 54 and roller 56. The shoulder pin 54 includes a head 58, a bearing surface 60, and a tail member 62. The roller 56 includes a rim 64 and a tubular roller member 66 having an inner diameter slightly larger than the outer diameter of the bearing surface 60 of the shoulder pin 54. The roller member 66 has an outer diameter slightly smaller than the width of the longitudinal slot 46. As indicated in FIG. 7 the shoulder pin 54 is inseted coaxially into the interior of the roller 56 allowing the roller to freely rotate about the shoulder pin 54.

The sliding plate 24 is positioned above the mounting plate 22 with the longitudinal slot 46 aligned with the shoulder pin holes 68. As is shown in FIG. 2 the roller bearings 52 are inserted through the longitudinal slot 46 and shoulder pin holes 68. The end members 62 are hammered over to form rivet heads, thereby securing the roller bearings 52 to the mounting plate 22 and allowing the sliding plate 24 to freely slide back and forth upon the roller bearings 52 along the mounting plate 22.

The operating mechanism 20 including the sliding plate 24, mounting plate 22, and roller bearings 52 is secured to the face of the circuit breaker 10 by screws 26 and 28, with the notch 70 engaging the actuating lever 34 of the circuit breaker 10. The two upper screws 26, as seen in FIG. 1, extend through holes 72 in the mounting plate 22 and mounting holes of the circuit breaker and are threaded into the rear surface of the enclosure 12. The lower screw 28 as seen in FIG. 1, extends through a mounting hole 74 in the mounting plate 22 and a slot 30 in the side of the circuit breaker 10 and is also threaded into the rear surface of the enclosure 12. The notch 70 engaging the actuating lever 34 of the circuit breaker 10 provides that movement of the sliding plate 24 back and forth in the direction indicated by the arrow 75 in FIG. 1 along the mounting plate 22 upon the roller bearings 52 will actuate the circuit breaker between "ON" and "OFF" positions. Since the roller bearings 52 are located on the side of the circuit breaker 10, the clearance required between the circuit breaker face and the interior surface of the enclosure cover 14 is reduced.

Figure 5:
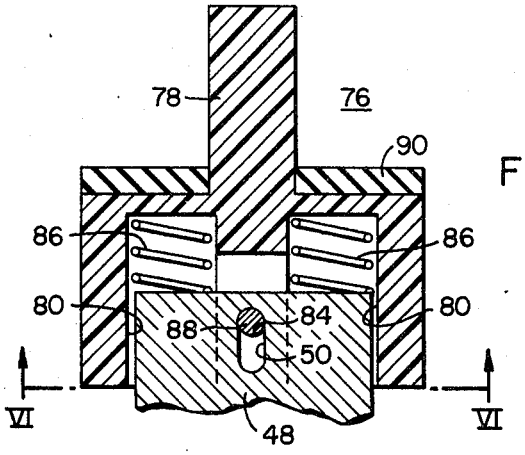
FIG. 5 is a sectional view of the handle structure shown in FIG. 1 taken along the line V—V.
Figure 6:
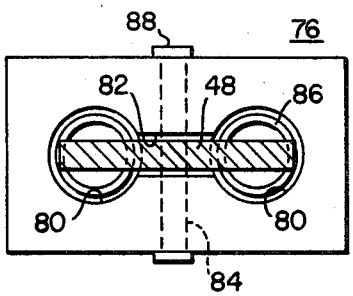
FIG. 6 is a sectional view of the handle structure shown in FIG. 5 taken along the line VI—VI.

FIG. 5 shows a molded handle structure 76 including a protruding actuating handle 78. The handle structure 76 is affixed to the sliding plate 24 to provide for external operation of the circuit breaker 10 when the cover 14 of the enclosure 12 is closed, in a manner to be hereinafter described. Extending into the rear of the handle structure 76 are two cylindrical cavities 80 connected by a slot-shaped cavity 82. A spring pin hole 84 passes laterally through the handle structure 76. Compression springs 86 are disposed within the cylindrical cavities 80. The handle structure 76 is placed upon the sliding plate so that it receives the handle seating tab 48, the slot-shaped cavity 82 forming a sliding fit upon the handle seating tab 48. Since the width of the handle seating tab 48 is greater than the width of the slot-shaped cavity 82 it extends into the cylindrical cavities 80, compressing the springs 86 therewithin. The handle structure 76 is yieldably secured to the handle seating tab 48 by a spring pin 88 inserted through the spring pin hole 84 in the handle structure 76 and the spring pin slot 50 of the handle seating tab 48, forming a lost motion connection.

A gasket 90 is disposed upon the face of the handle structure 76. When the cover 14 of the enclosure 12 is closed, as in FIG. 2, the actuating handle 78 extends through the handle aperture 19 of the cover 14. The cover 14 forces the handle structure 76 vertically downward as seen in FIG. 2 upon the handle seating tab 48 against the biasing action of the springs 86. The pressure thus applied by the springs 86 between the gasket 90 disposed between the face of the handle structure 76 and the interior surface of the enclosure cover 12 forms a dust-tight seal around the handle aperture 19. Movement of the extending actuating handle 78 by an operator in a direction perpendicular to the plane of the drawing in FIG. 2 causes the sliding plate 24 to move in a similar direction along the mounting plate 22 upon the roller bearings 52, thereby actuating the lever 34 and moving the circuit breaker 10 between "ON" and "OFF" positions. The yieldable lost motion connection between the spring pin 84 and the slot 50, and the upward (FIG. 2) pressure exerted by the springs 86 upon the gasket 90 maintains the dust seal around the aperture 19 throughout this operation. The roller bearings minimize the friction between the sliding plate 24 and mounting plate 22 thereby reducing the force required to actuate the circuit breaker.

As can be seen in FIGS. 1 and 2 a U-shaped latch member 94 is mounted upon the interior surface of the enclosure cover 14. When the cover 14 is closed and the handle 78 is moved to the "ON" position, the interlocking tab 53 engages the latch member 94, thereby preventing the cover 14 from being opened while the circuit breaker is in the "ON" position.

Since the sliding plate 24 is movably supported by the mounting plate 22 upon roller bearings 52, the force required to actuate the circuit breaker through the operating mechanism 20 is minimized. The roller bearings 52 are located at the side of the circuit breaker 10 rather than upon its face, thereby reducing the clearance required between the face of the circuit breaker 10 and the interior surface of the enclosure cover 14.

The operating mechanism 20 described can also be mounted in conjunction with a disconnect switch or other device wherein it is desired to enclose the device in a sealed cabinet and actuate the device by means of an external operating mechanism.

From the foregoing it is seen that the present invention has provided a new and improved control device including a circuit interrupter disposed within a sealed enclosure and actuable by means of an operating mechanism movably supported upon roller bearings and extending external to the sealed enclosure.

While the present invention has been shown and described in only one form, it will be obvious to those skilled in the art that it is not so limited, but is susceptible to various changes and modifications without departing from the spirit thereof.

What is claimed is:

1. A control device comprising:

an enclosure having an openable cover, said cover having a handle aperture;

a circuit interrupter disposed within said enclosure and having four sides and a face perpendicular to said sides, said interrupter comprising an actuating lever extending from said face and being movable to actuate said circuit interrupter to "ON" and "OFF" positions; and an operating mechanism comprising a mounting plate affixed to said circuit interrupter and having a member substantially perpendicular to said face and adjacent one of said sides, a sliding plate movably attached to said perpendicular member and engaging said actuating lever, and a handle structure attached to said sliding plate and having a portion extending through said handle aperture, movement of said extending portion moving said sliding plate and said actuating lever to actuate said circuit interrupter to "ON" and "OFF" positions.

2. A control device as described in claim 1 wherein said perpendicular member includes cylindrical rollers affixed thereto and movably supporting said sliding plate.

3. A control device as described in claim 1 wherein said handle structure comprises means biasing said handle structure against the inner surface of said enclosure cover, said handle structure comprising a gasket disposed between said handle structure and the interior surface of said enclosure cover, said biasing means and said gasket providing a sliding seal about said handle aperture.

4. A control device as claimed in claim 1 wherein:

said sliding plate comprises an interlock tab extending therefrom and said enclosure cover comprises a latch member on the interior surface thereof, said latch member cooperating with said interlock member so that movement of said sliding plate to a position corresponding to the "ON" position of said circuit interrupter with said enclosure cover closed engages said interlock member with said latch member to prevent opening of said cover.

5. A control device as described in claim 1 wherein said handle structure is connected to said sliding plate through a lost motion connection.

6. A handle-operating mechanism adapted for use in association with a circuit interrupter of the type having an actuating lever and being mounted within an enclosure having a cover, said mechanism comprising:

a mounting plate adapted to be affixed to an associated circuit interrupter;

a sliding plate movably secured to said mounting plate and adapted to engage the actuating lever of an associated circuit interrupter; and a handle structure comprising an actuating handle secured to said sliding plate by a lost motion connection and extending through an aperture in the enclosure cover, a gasket disposed between said handle structure and the enclosure cover, and means biasing said handle structure and said gasket against the interior surface of the enclosure cover to provide a dust-tight seal between said handle structure and the enclosure cover.

* * * * *